US009920493B2

(12) United States Patent
Provost

(10) Patent No.: US 9,920,493 B2
(45) Date of Patent: Mar. 20, 2018

(54) ARTICULATING FLUID APPLICATION DEVICE AND METHOD

(71) Applicant: Bruce Provost, Lakeside, CA (US)

(72) Inventor: Bruce Provost, Lakeside, CA (US)

( * ) Notice: Subject to any disclaimer, the term of this patent is extended or adjusted under 35 U.S.C. 154(b) by 140 days.

(21) Appl. No.: 15/004,898

(22) Filed: Jan. 23, 2016

(65) Prior Publication Data

US 2017/0009411 A1 Jan. 12, 2017

Related U.S. Application Data

(60) Provisional application No. 62/188,984, filed on Jul. 6, 2015.

(51) Int. Cl.
*E01C 23/22* (2006.01)
*B05B 13/00* (2006.01)
*B05B 9/00* (2006.01)

(52) U.S. Cl.
CPC ..... *E01C 23/22* (2013.01); *B05B 9/007* (2013.01); *B05B 13/005* (2013.01)

(58) Field of Classification Search
CPC ..... E01C 23/206; E01C 23/22; E01C 23/16; B05B 7/0093; B05B 15/0487; B05B 9/007; B05B 13/005
USPC ..... 239/146, 150, 151, 159, 164, 176, 172, 239/754; 248/214, 227.4, 222.14, 405, 248/354.8; 118/305
See application file for complete search history.

(56) References Cited

U.S. PATENT DOCUMENTS 4,624,602 A * 11/1986 Kieffer ..... E01C 23/22 118/305
4,893,751 A * 1/1990 Armstrong ..... E01C 23/22 118/305
5,302,207 A * 4/1994 Jurcisin ..... E01C 23/22 118/207
7,237,783 B2 * 7/2007 Kieffer ..... E01C 23/22 239/150
7,314,186 B1 * 1/2008 Aesch, Jr. ..... A01M 21/043 239/146
7,673,815 B2 * 3/2010 Schroeder ..... E01C 23/22 239/146

* cited by examiner

*Primary Examiner* — Alexander Valvis
*Assistant Examiner* — Juan C Barrera
(74) *Attorney, Agent, or Firm* — Thibault Patent Group

(57) ABSTRACT

A liquid spray device is described for applying a variety of liquids, such as paint, to a surface. In one embodiment, the liquid spray device comprises a frame, an axel mounted to the frame, two wheels, each attached to the axel at opposing ends of the axel, a spray gun mount coupled to the axel, and a spray gun mounted to the spray gun mount comprising a nozzle in substantially vertical alignment with the axel, for applying the liquid under pressure to a surface.

9 Claims, 9 Drawing Sheets

ARTICULATING FLUID APPLICATION DEVICE AND METHOD

RELATED APPLICATIONS

This application claims the benefit under 35 U.S.C. 119(e) to U.S. Provisional Patent Application Ser. No. 62/188,984, filed Jul. 6, 2015, entitled "Articulating Spray Gun Mount", incorporated by reference in its entirety herein.

BACKGROUND

Field of Use

The present application relates to the field of construction-related spray applications of fluid materials. More specifically, embodiments of the present invention relate to an apparatus and method for accurately applying paint and other liquid substances to outdoor surfaces.

Description of the Related Art

Outdoor commercial spray painting has been in use for many years. One particular application of such outdoor spray painting is in the asphalt striping business, where paint striping is used to create parking spaces, create traffic lanes on roads, provide information to motorists, and many other uses. While such painting was performed manually by hand many years ago, paint striping machines have been developed to make the job of painting faster and more accurate.

One of such paint striping machines is shown in FIG. 1, where a paint spray gun is mounted to a cart. The paint spray gun is typically mounted to a frame of the cart and pointed in a downward direction to apply paint or other liquid materials to a surface to be painted. A human operator pushes the cart and visually determines where the spray gun applies the paint, which is typically forced from the spray gun from a compressor mounted to the cart. Application of the paint from the spray gun is controlled by a lever near the cart's handle which opens a valve in line with a hose that connects a paint source with the spray gun. In operation, the human operator pushes the cart over a surface to be painted, such as an asphalt parking lot, guiding the cart, and hence the spray gun, to form painted lines that form parking spaces, traffic lanes, etc.

There are a number of problems with such prior-art liquid spray devices. First and foremost, the application accuracy of the paint may be compromised as the cart is pushed over uneven surfaces, as the spray gun is mounted at a location different than the cart wheels. Thus, as the cart wheels experience a dip or bump in the painting surface, the spray gun tends to move vertically with respect to the painting surface, causing variations in the application of the paint to the painting surface. In an asphalt-striping application, for example, the lines produced by such a prior art liquid spray device results in lines that vary in width, creating an unattractive visual appearance.

Another problem with prior art liquid spray devices is that vibration caused as the machine is pushed along the painting surface also creates variations and imperfections on the painting surface, such as blurry lines in a paint-striping application.

Yet another problem with prior art liquid spray devices is that the spray gun cannot be moved to accommodate every possible painting surface orientation. For example, most liquid spray devices only provide for a fixed spray gun for painting lines on surfaces, but cannot be used to apply paint to vertical surfaces such as curb faces, or positioned at an angle to accommodate other, irregular surfaces that may be encountered in the field.

What is needed is a liquid spray device that overcomes the problems in the prior art.

SUMMARY

The embodiments described herein relate to a liquid spray device for applying one of a variety of liquids, such as paint, to a surface. In one embodiment, the liquid spray device comprises a frame, an axel mounted to the frame, two wheels, each attached to the axel at opposing ends of the axel, a spray gun mount coupled to the axel, and a spray gun mounted to the spray gun mount comprising a nozzle in substantially vertical alignment with the axel, for applying the liquid under pressure to a surface.

BRIEF DESCRIPTION OF THE DRAWINGS

The features, advantages, and objects of the embodiments discussed herein will become more apparent from the detailed description as set forth below, when taken in conjunction with the drawings in which like referenced characters identify correspondingly throughout, and wherein.

DETAILED DESCRIPTION

The inventive concepts described herein relate to embodiments of a novel liquid spray device. In one embodiment, the liquid spray device comprises a spray gun mounted to an axel of a movable cart via a spray gun mount, which enables the spray gun to be positioned at virtually any angle and at any chosen distance from an application surface. In addition, the spray gun mount allows a nozzle of the spray gun to be positioned in substantial vertical alignment with the axel. This arrangement allows for uniform striping on surfaces regardless of bumps, dips, or other irregularities that may be encountered in the application surface. Finally, the liquid spray device described herein is far less expensive, and more accurate, than similar devices on the market today.

Figure 1:
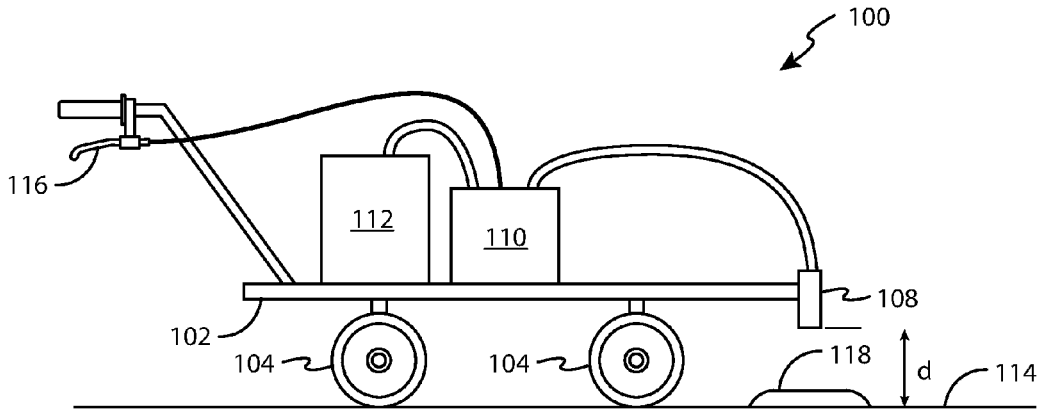
Prior Art FIG. 1
FIG. 1 is a perspective view of a prior art liquid spray device.

FIG. 1 is a side view illustration of a prior art liquid spray device 100, typically used in outdoor painting applications such as parking lot striping, vehicle lane creation on roads, etc. Liquid spray device 100 typically comprises a frame 102 having at least three wheels 104 attached to the frame 102, two at a fore position and at least one in a rear position of the liquid spray device 100 (one of the wheels hidden from view in FIG. 1 by the wheel nearest the viewing position). A spray nozzle 108 is mounted to the front of frame 108, pointed in a downward direction perpendicular to frame 102 and generally to the surface 114 to be painted. The area of surface 114 covered by the paint from nozzle 108 is partially dependent on the distance d that the nozzle is positioned from surface 114. In some embodiments, nozzle 114 may be adjustable in a vertical direction to increase or decrease the size of the spray pattern.

The spray nozzle 108 receives paint under pressure from compressor 110, which in turn receives paint from paint source 112. The paint provided to spray nozzle is atomized and applied to a surface 114 to be painted, such as a parking lot or road. The spray nozzle 108 is controlled by a human operator of liquid spray device 100 via a human trigger device 116 which provides a signal to compressor to provide paint to nozzle 108 or not. In other applications, compressed air is provided to spray nozzle 108, which aids in atomization of the liquid.

Prior art liquid spray device 100 is limited to painting perpendicularly to painting surface 114, due to the fixed relationship between nozzle 108 and frame 102. This not only limits the applications that prior art liquid spray device 100 can be used, but also creates problems when an anomaly is encountered during the painting process, such as variations in surface 114 such as bump 118, or more generally, variations due to surface 114 not being uniformly flat.

Figure 2A:
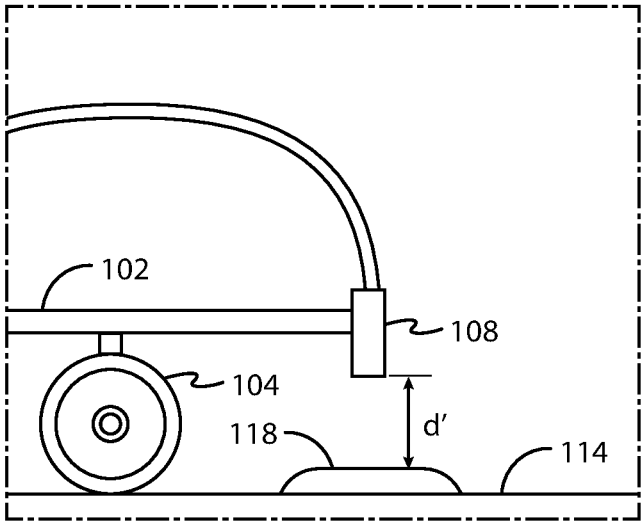
FIG. 2*a* illustrates a close-up view of the front portion of the prior art liquid spray device just before encountering a bump.

FIG. 2*a* illustrates a close-up view of the front portion of prior art liquid spray device 100 just before bump 118 is encountered. Bump 118 may comprise a speedbump (or speedhump) or simply a raised portion of surface 114 formed by uneven grading of surface 114 during construction. Just before wheels 104 encounter bump 118, nozzle 108 is already positioned over bump 118, due to the lateral offset between wheels 104 and nozzle 108 on frame 102. This reduces the distance d between nozzle 108 and the surface to be painted, now bump 118, to d', resulting in a reduced painting pattern over the surface of bump 118. This causes deformations in stripes created as prior art liquid spray device 100 is pushed along surface 114, i.e., the stripes become narrower as the nozzle passes over bump 118 prior to wheels 104 encountering the bump 114.

Figure 2B:
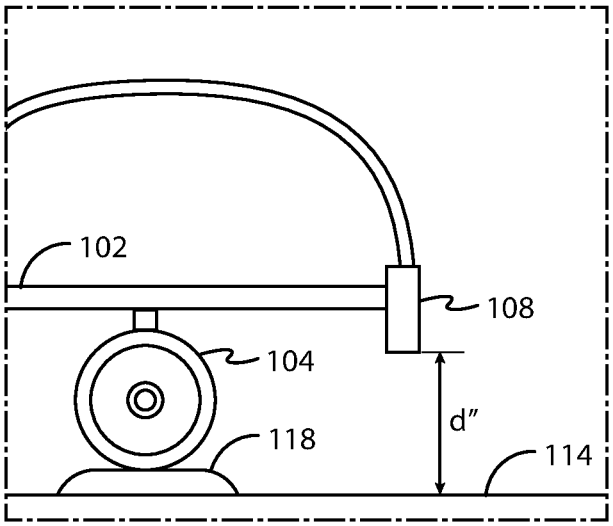
FIG. 2*b* illustrates the prior art liquid spray device shown in FIGS. 1 and 2*a* when its wheels are on top of the bump shown in FIG. 2*a;*

Similarly, as shown in FIG. 2*b*, after prior art liquid spray device 100 has been pushed a little further than the position shown in FIG. 2*a*, wheels 104 are on top of bump 118, and nozzle 108 is displaced a distance d" from surface 114, which is a distance greater than d in FIG. 1. The increased distance d" results in an increased painting pattern over surface 114, thereby resulting in stripes becoming wider as wheels 104 pass over bump 118.

Figure 3:
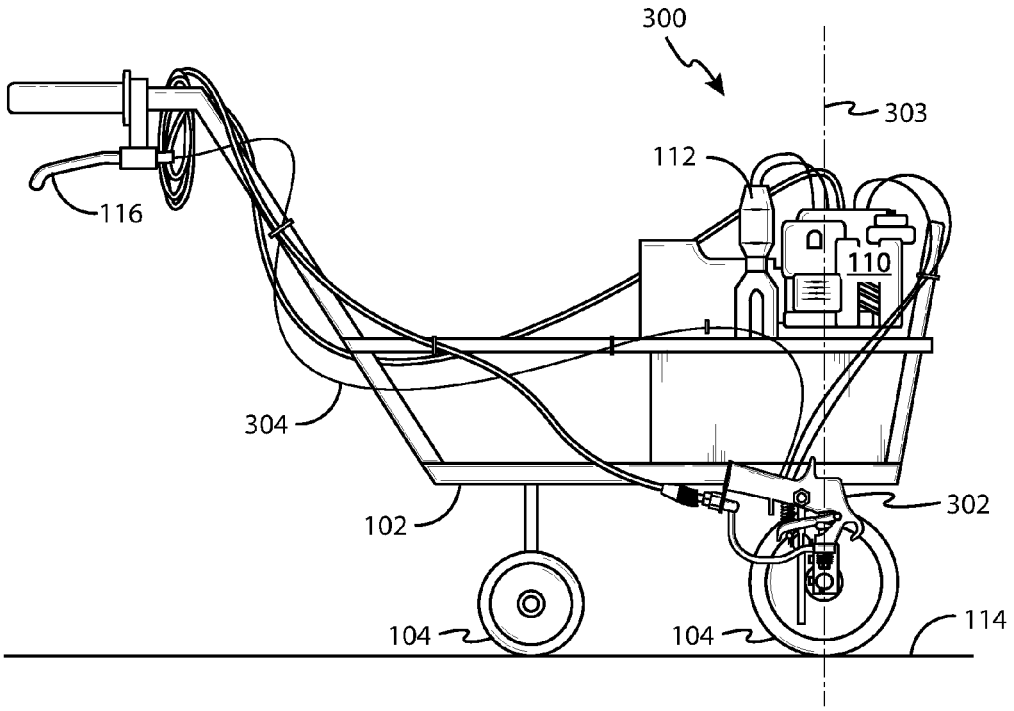
FIG. 3 is a side view of one embodiment of a liquid spray device 300 in accordance with the principles described herein.

FIG. 3 is a side view of one embodiment of a liquid spray device 300 in accordance with the principles described herein. In this embodiment, liquid spray device 300 comprises an airless spray gun 302, for example, a DP-600 High Pressure Airless Spray Gun manufactured by Ningbo Dino-Power Machinery Co., LTD., of Ningbo, China. In other embodiments, liquid spray device 300 comprises a compressed air spray gun that uses compressed air to draw paint from paint source 112 in order to spray the paint onto surface 114. Similar to FIG. 1, shown is frame 102 having wheels 104 attached thereto, paint source 112, compressor 110 and human trigger device 116. Newly shown is spray gun 302 and paint gun control linkage 304. Hidden from view behind spray gun 302 and in front of wheels 104 is a spray gun mount which will be described in detail later herein.

Figure 4:
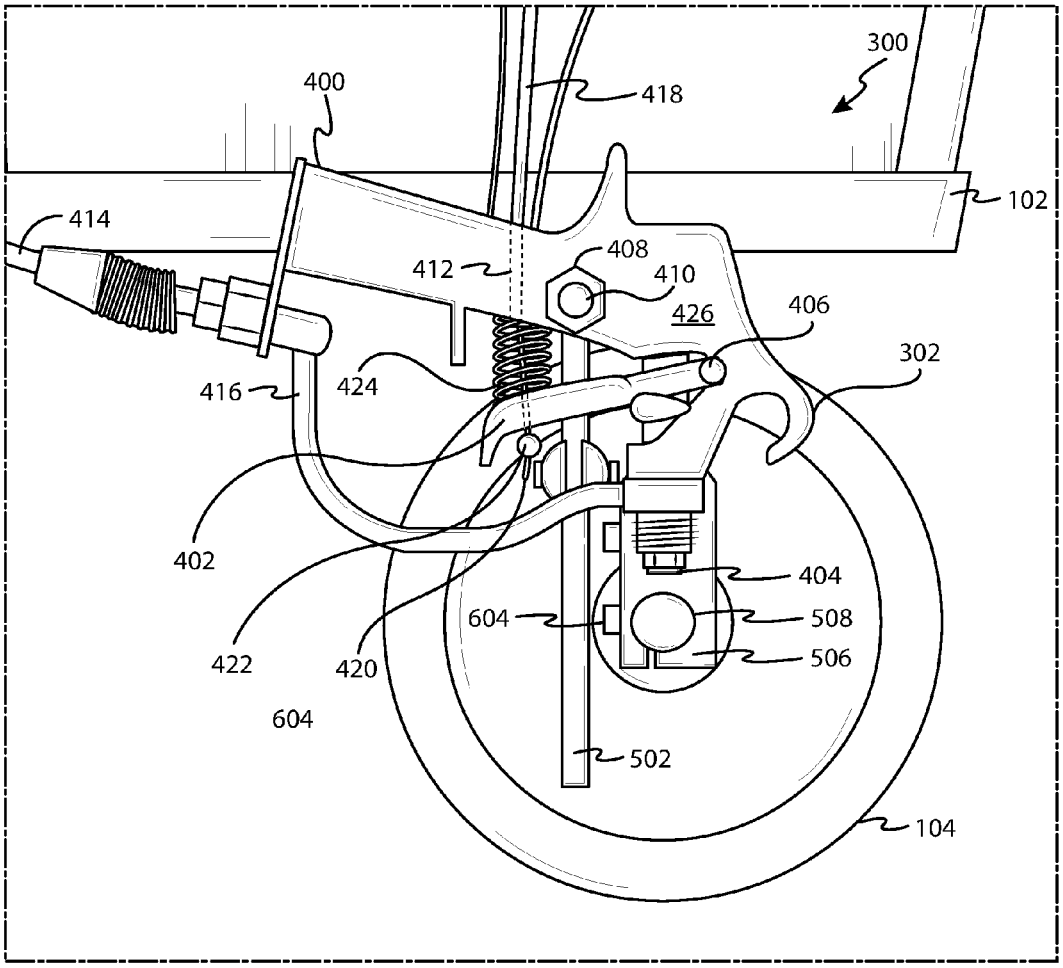
FIG. 4 is a close-up, side view of one embodiment of a spray gun.

As shown in FIG. 3, liquid spray device 300 comprises spray gun 302 whose nozzle 404 (as shown in FIG. 4) is positioned in substantial vertical alignment with the wheels 104 and/or the axel (not shown), e.g., a nozzle portion of spray gun 302 is substantially in alignment with a centerline 303 of wheels 104 and/or axel, when viewed from the side as shown in FIG. 3. In this orientation, the distance from spray gun 302 to surface 114 does not change, even when liquid spray device 300 encounters bumps or dips in surface 114, because of the inventive alignment of the spray gun 302 with wheels 104. Moreover, mounting spray gun 302 to the axel of liquid spray device 300 via the spray gun mount reduces the effect of vibration to liquid spray device 300 as liquid spray device 300 is operated, due again to the fact of the spray gun being mounted in congruence with wheels 104. The vertical displacement of wheels 104, and in turn frame 102, that occur due to surface-induced vibrations as the liquid spray device 300 is operated results generally in a direct 1:1 vertical displacement of spray gun 302 in relation to wheels 104.

FIG. 4 is a close-up, side view of one embodiment of spray gun 302, shown again as an airless spray gun 302 mounted to an axel of liquid spray device 300 via a spray gun mount, again not shown in this view. Shown is handle 400, trigger 402, nozzle 404, trigger pin 406, retaining means 408, an end portion 410 of a spray gun holding component that is part of the aforementioned spray gun mount, through hole 412, paint supply tube 414 connected to spray gun paint supply conduit 416, a cable assembly comprising a cable jacket 418 and cable 420, a cable retainer 422, and a trigger spring 424. In this embodiment, paint is delivered to nozzle 404 under pressure from compressor 110 via paint supply tube 414 that is connected to rigid spray gun paint supply conduit 416 via traditional coupling means, such as a swivel-type NPSM connector. Paint spray is controlled by an operator of liquid spray device 300 using human trigger device 116 which, in one embodiment, causes cable 420 running inside the length of cable jacket 418, to be pulled, thereby causing trigger 402 to be pulled as a result of an end of cable 420 being retained by cable retainer 422, which is typically an anchor bolt well-known in the art. Means other than a cable and jacket may be used to cause trigger 402 to be pulled in other embodiments, such as air-based or electronics-based means.

When trigger 402 is pulled via human trigger device 116 and cable 420, paint is sprayed from nozzle 404 onto surface 114 in a spray pattern that produces straight, thick lines on surface 114 as liquid spray device 300 is pushed over surface 114 by the operator. When human trigger device 116 is released, trigger spring 424 typically moves trigger 402 back to an un-pulled position, thereby cutting off the flow of paint to nozzle 404. Trigger 402 rotates around an axis formed by trigger pin 406, which usually comprises a rivet or bolt that rotatably secures trigger 402 to the rest of spray gun 302.

As mentioned previously, spray gun 302 is mechanically coupled to an axel 508 of liquid spray device 300 via a spray gun mount, a portion of which is shown in FIG. 4 as end portion 410 of a spray gun holding component of the spray gun mount. End portion 410 is placed through a hole (not shown) in a planar surface 426 of spray gun 302, generally in the vicinity as shown in FIG. 4. Spray gun 302 is rigidly held to the spray gun holding component when retaining means 408 is tightened. In one embodiment, retaining means 408 comprises a nut that is screwed onto threads that make up end portion 410, however in other embodiments, retaining means could comprise a clamp, a bolt, a screw, or some other mechanical fastening device that secures spray gun 302 to end portion 410. It should be understood that spray gun 302 may be rotated about an axis formed along a centerline of end portion 410, i.e., in FIG. 4, rotatable clockwise and counterclockwise around end portion 410, prior to being secured when retaining means 408 is tightened. This allows spray gun 302 to be positioned at an angle with respect to surface 114 in a fore and aft direction in the direction of travel of liquid spray device 300.

Figure 5:
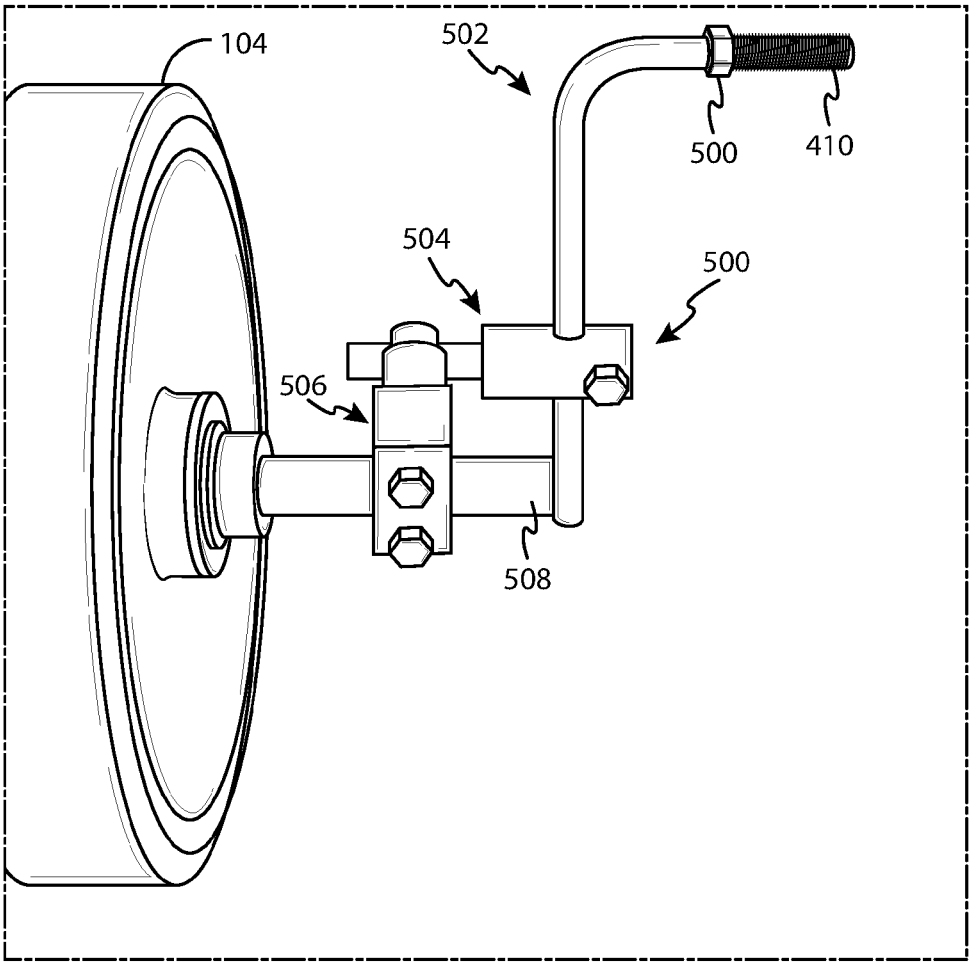
FIG. 5 is a perspective view of one embodiment of a spray gun mount as part of the liquid spray device of FIG. 3.

FIG. 5 is a perspective view of one embodiment of a spray gun mount 500, as mentioned earlier herein, without spray gun 302 attached. In this embodiment, spray gun mount 500 comprises a spray gun holding component 502, a horizontal component 504, and an axel attachment component 506. Spray gun mount 500 is coupled to axel 508 of liquid spray device 300. In this embodiment, axel attachment component 506 comprises a clamping mechanism that allows axel attachment component 506 to be rotatably clamped onto axel 508. In other embodiment, axel attachment component 506 could comprise other mechanisms to attach axel attachment component 506 to axel 508, such as bolts, screws, rivets, etc. The clamping mechanism allows the entire spray gun mount 500 to be rotated about an axis formed longitudinally through axel 508 and, by extension, spray gun 302.

Figure 6:
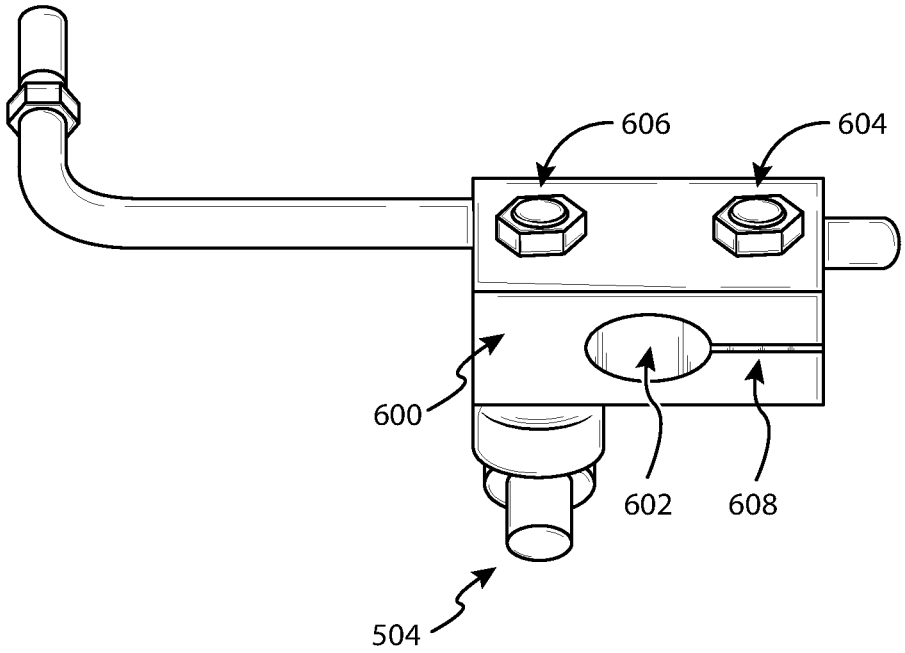
FIG. 6 is a different perspective view of the spray gun mount shown in FIG. 5.

In the embodiment shown in FIG. 5, axel attachment component 506 comprises a unitary body 600 (best shown in FIG. 6) comprising a through hole 602, a clamping fastener 604, a tension fastener 606, and a slot 608. In other embodiments, unitary body 600 could comprise two sections, i.e., a body and a "cap" that are joined together once the clamping fastener 604 and tension fastener 606 are tightened. In this embodiment, the body 600 is placed over axel 508, then clamping fastener 604 is tightened via opposing threads formed in a threaded void 738 (shown in FIG. 7) opposing clamping fastener 604. This forces slot 608 closed and the diameter of the through hole 602 to decrease, providing a clamping effect on axel 508.

Figure 7:
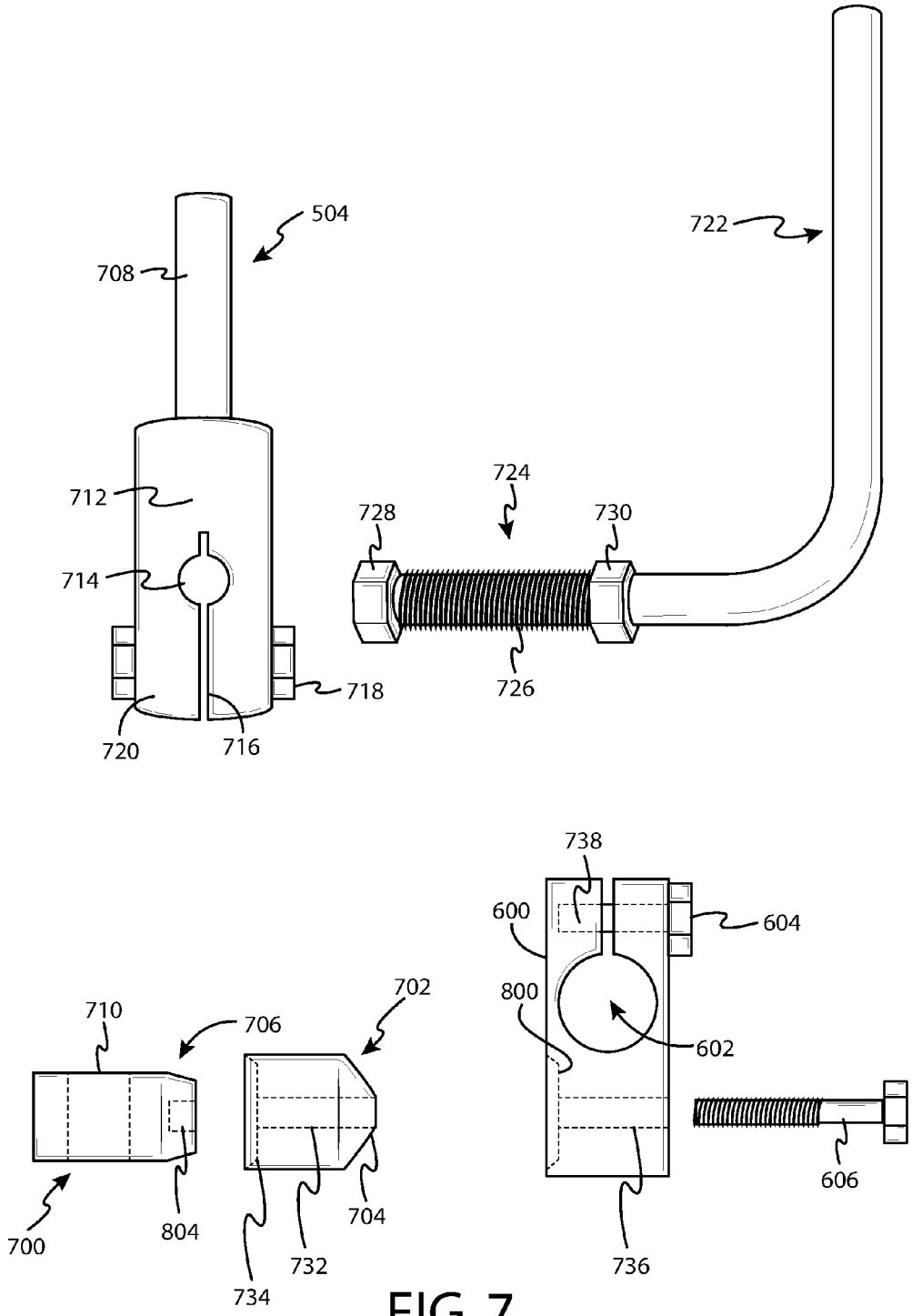
FIG. 7 is an exploded view of the spray gun mount shown in FIGS. 5 and 6.
Figure 8:
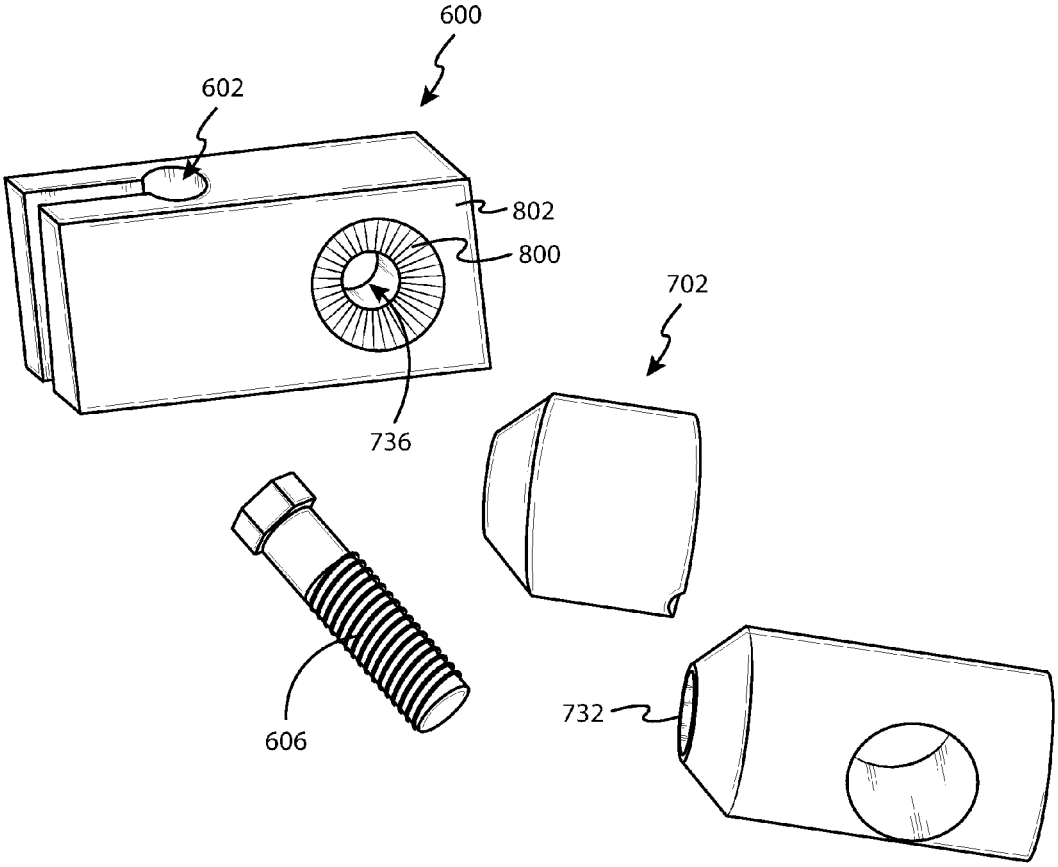
FIG. 8 is an exploded view of an axel attachment component as part of the spray gun mount shown in FIGS. 5, 6 and 7.

Reference shall now be made to FIGS. 7 and 8.

Figure 9A:
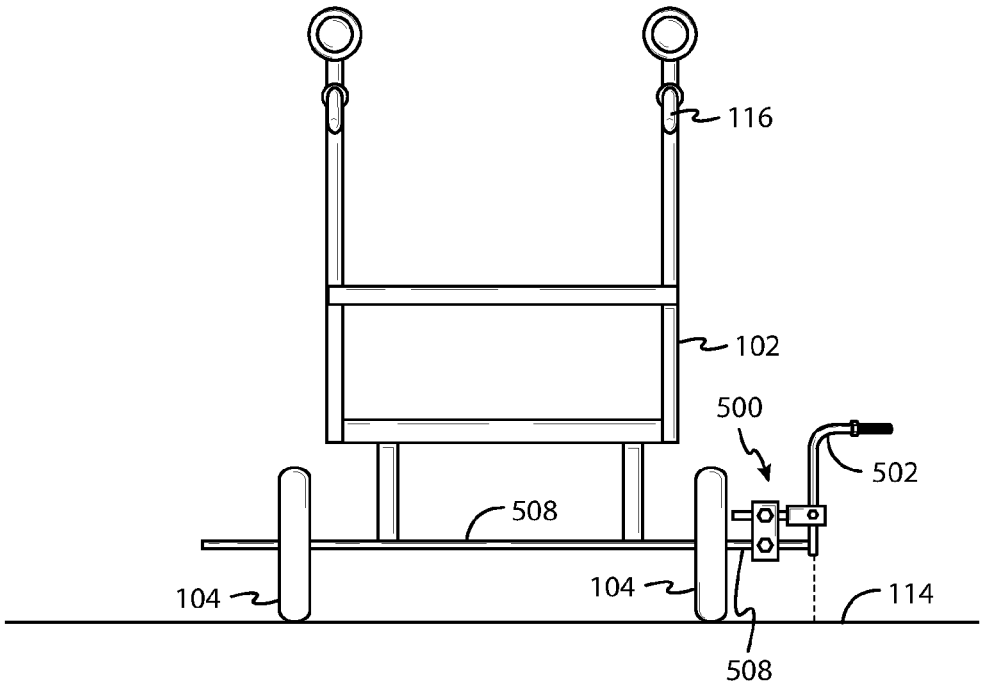
FIG. 9*a* is a rear plan view of the liquid spray device of FIG. 3 with the spray gun mount of FIG. 5 shown in a first alignment.
Figure 9B:
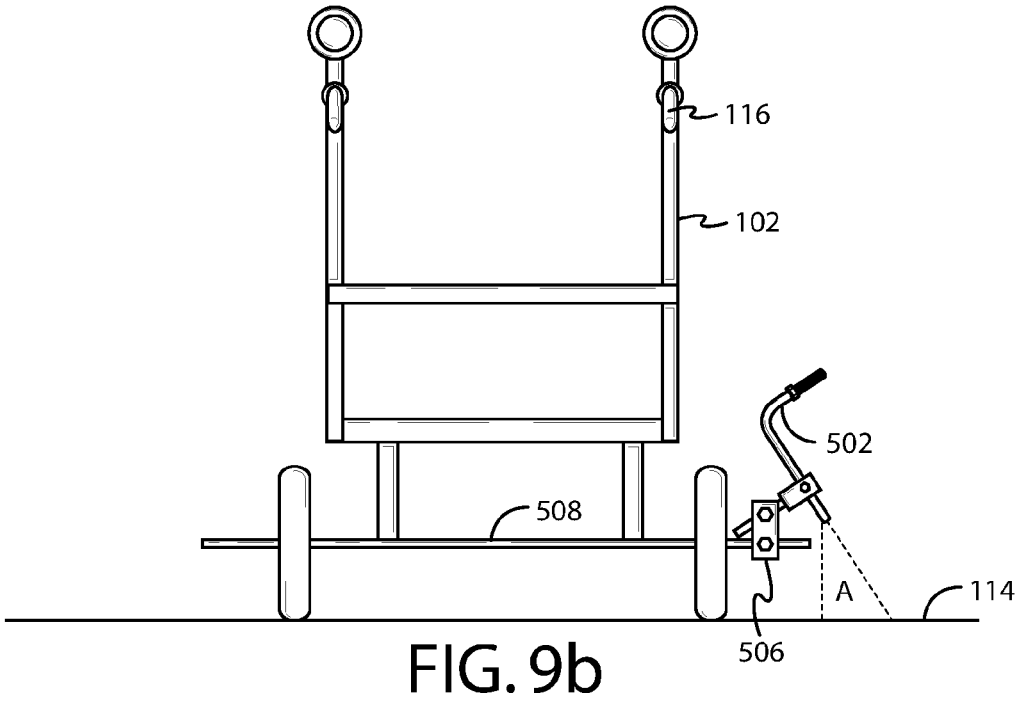
FIG. 9*b* is a rear plan view of the liquid spray device of FIG. 3 with the spray gun mount of FIG. 5 shown in a second alignment.

Next, in this embodiment, shaft 708 of horizontal component 504 is placed through through hole 710 of beveled mounting shaft 700 at a desired location along shaft 708, then shaft 708 is secured against beveled mounting shaft 700 by a tension force formed by tightening tension fastener 606 as tension fastener 606 is placed through through-hole 736 of body 600. Beveled mounting shaft 700 is coupled to body 600 via beveled coupling 702 (best shown in FIG. 7), comprising a beveled end 704 which in turn seats into a reciprocal beveled void 800 (best shown in FIG. 8) formed into an underneath surface 802 of body 600. The beveled coupling 702 comprises a longitudinal through-hole 732 allowing tension fastener 606 to pass during assembly. In one embodiment, through-hole 732 comprises threads for engaging threads on tension fastener 606. Beveled mounting shaft 700 also comprises a beveled end 706 that engages a reciprocal beveled void 734 formed longitudinally into the non-beveled end of beveled coupling 702. The beveled mounting shaft 700 additionally comprises a threaded hole 804 formed longitudinally into beveled end 706 for engagement with the threads on tension fastener 606. Thus, horizontal component 504 is coupled to the axel attachment component 506 via a tension force created as tension fastener 606 is placed through hole 736 and 732, and secured to beveled mounting shaft 700 via beveled coupling 702 through hole 804. This arrangement allows horizontal component 504 to be rotated around a longitudinal axis of horizontal component 504 causing spray gun 302 to be rotated with respect to surface 114 along a travel direction of liquid spray device 100, as well as a linear adjustment to move spray gun 302 towards or away from liquid spray device 100. Further, the rotational coupling of beveled mounting shaft 700 to axel attachment component 506 allows horizontal component 504 to be rotated about a longitudinal axis of beveled mounting shaft 700, causing the spray gun 302 to rotate laterally with respect to liquid spray device 100, best shown by FIGS. 9*a* and 9*b*, with FIG. 9*a* showing liquid spray device 100 from a rear view, and spray gun mount 500 coupled to axel 508 (any rear wheels/axel are omitted for purposes of clarity). Spray gun mount 500 is positioned in a vertical orientation, i.e., along an axis formed perpendicular to surface 114 along the long length of spray gun holding component 502. In FIG. 9*b*, beveled mounting shaft 700 has been rotated with respect to axel attachment component 506, resulting in the axis of spray gun holding component 502 to form an angle with respect to surface 114. This causes spray gun 302 to be rotated laterally with respect to liquid spray device 100, forming an angle "A" with respect to surface 114 as shown. It should be understood that in some embodiments, beveled coupling 702 is not used, and beveled mounting shaft 700 is coupled directly to body 600 via beveled void 800.

Horizontal component 504 is best shown in FIGS. 5 and 7. In this embodiment, it comprises a cylinder having two sections, shaft 708 and body 712, both shaped as cylinders in this embodiment. Allowing shaft 708 to be cylindrical allows horizontal component 504 to rotate about a longitudinal axis of horizontal component 504, while the shape of body 712 need not be cylindrical. In other embodiments, the size, shape, and cross-sections may be different, and in still other embodiments, shaft 708 and body 712 may have the same diameter. Shaft 708 is sized for reception into through hole 710 of beveled mounting shaft 700, as described above. Body 712 comprises through hole 714, slot 716, and a clamping fastener 718 (best shown in FIG. 7). The through hole 714 is sized to accommodate a diameter of the spray gun holding component 502. The slot 716 is formed onto the end of body 712, meeting the through hole 714, similar to the arrangement of through hole 602 and slot 608 of body 600. This allows spray gun holding component 502 to be clamped within through hole 714, by tightening clamping fastener 718, which in turn causes through hole 714 to tighten around the diameter of spray gun holding component 502. Clamping fastener 718 is typically a bolt that engages reciprocal threads formed into an opposing side 720 of body 712, but could alternatively comprises a through hole where clamping fastener 718 would be secured by a nut on the outer surface of body 712.

In one embodiment, spray gun holding component 502 comprises an L-shaped cylindrical rod having a first elongated portion 722 for coupling to horizontal component 504 via through hole 714, as explained above, and a second portion 724 for attaching spray gun 302. In this embodiment, second portion 724 comprises threads 726 for either direct coupling to reciprocal threads formed through spray gun 302 or for placement through a through hole of spray gun 302, where fastener 728 is screwed onto threads 726 and tightened so that spray gun 302 is sandwiched between fastener 728 and mechanical stop 730 which, in this embodiment, comprises a nut. In this embodiment, mechanical stop 730 may be positioned along the threads 726, thereby allowing lateral adjustment of the spray gun along the threaded end portion. The length of portion 722 is chosen long enough to allow placement of spray gun 302 at a variety of distances from surface 114 while small enough to avoid interference with surface 114 while painting.

When all three components have been assembled, and spray gun 302 attached to second portion 724, spray gun 302 may be articulated into virtually any angle with respect to surface 114, including vertical surfaces such as curb faces and the like, as well as configurable to be positioned at a variety of desired distances from surface 114, by adjusting the spray gun mount 500 components laterally or angularly with respect to each other, as described above.

Each of the spray gun mount 500 components is typically made from non-deforming materials, such as metal, plastic, or polymers, and are formed using traditional methods of machining or manufacturing.

The previous description of the preferred embodiments is provided to enable any person skilled in the art to make and use the concepts described herein. The various modifications to these embodiments will be readily apparent to those skilled in the art, and the generic principles defined herein may be applied to other embodiments without the use of the inventive faculty. Thus, the ideas presented are not intended to be limited only to the embodiments discussed herein, but are to be accorded the widest scope consistent with the principles and novel features disclosed herein.

I claim:

1. A liquid spray device, comprising: a frame; an axle mounted to the frame; two wheels, each attached to the axle at opposing ends of the axle; a spray gun mount coupled to the axle, comprising: a spray gun holding component coupled to a spray gun; an axle attachment component coupled to the axle, comprising a body; a clamping mechanism formed onto one end of the body for rotatable and lateral attachment of the axle attachment component to the axle; and a mounting shaft extending perpendicularly from a surface of the body, wherein the mounting shaft is rotatable with respect to the body around a longitudinal axis through the length of the mounting shaft, allowing the spray gun mount to be rotated about the longitudinal axis and a horizontal component coupled to the spray gun holding component and the axle attachment component; the spray gun mounted to the spray gun mount comprising a nozzle in substantial alignment with the axle, for applying a liquid under pressure to a surface; and a tension fastener; wherein the body comprises a hole formed therethrough; wherein the mounting shaft comprises a threaded hole formed into one end of the mounting shaft; and wherein the tension fastener is configured for placement through the hole and into the threaded hole forming a rotatable coupling between the body and the mounting shaft.

2. The liquid spray device of claim 1, wherein the spray gun mount is configured to allow positioning of the spray gun at any angle relative to the surface.

3. The liquid spray device of claim 2, wherein the spray gun mount is configured to allow positioning of the spray gun at a variety of distances away from the surface.

4. The liquid spray device of claim 1, wherein the spray gun holding component comprises:

a threaded end portion for insertion through a planar surface of the spray gun;

a mechanical stop located at one end of the threaded end portion; and a fastening device for placement at an opposing end of the threaded end portion opposite the mechanical stop, for clamping the spray gun to the mechanical stop while allowing rotatable placement of the spray gun with respect to an axis formed longitudinally through the threaded end portion.

5. The liquid spray device of claim 4, wherein the mechanical stop is positionable along the threaded end portion, thereby allowing lateral adjustment of the spray gun along the threaded end portion.

6. The liquid spray device of claim 1, further comprising:

a beveled coupling having a through hole formed through a longitudinal axis of the beveled coupling, for placement between the mounting shaft and the body and for allowing the tension fastener to pass through.

7. The liquid spray device of claim 1, wherein the horizontal component comprises: a shaft having a first end for rotatable coupling to the axle attachment component about an axis through the shaft; and retaining means formed into a second end of the shaft for rotatable coupling to the spray gun holding component, allowing the spray gun to be positioned laterally with respect to the surface to be painted.

8. The liquid spray device of claim 1, wherein the spray gun comprises:

a hole formed through a planar surface of the spray gun for passing the spray gun holding component.

9. The liquid spray device of claim 1, further comprising:

a paint supply line for supplying the spray gun with paint;

a cable coupled between an operator trigger device and a spray gun trigger;

wherein the spray gun comprises a hole formed through a handle of the spray gun for placement of the cable therethrough and coupled to the spray gun trigger.

* * * * *